United States Patent [19]

Tokoro et al.

[11] 4,449,856

[45] May 22, 1984

[54] GROUT INJECTION METHOD AND APPARATUS

[75] Inventors: Takehiko Tokoro, Iruma; Shoichi Kashima, Sagamihara; Mineo Murata, Tokyo, all of Japan

[73] Assignees: Nihon Soil Engineering Co., Ltd.; Nihon Sogo-Bosui Co., Ltd.; Yamaguchi Kikai Kogyo Co., Ltd., all of Tokyo, Japan

[21] Appl. No.: 345,445

[22] Filed: Feb. 3, 1982

[30] Foreign Application Priority Data

Dec. 16, 1981 [JP] Japan ..... 56-204047

[51] Int. Cl.[3] ..... E02D 3/12

[52] U.S. Cl. ..... 405/269; 405/258

[58] Field of Search ..... 405/269, 258, 260, 262, 405/263, 266

[56] References Cited

U.S. PATENT DOCUMENTS 4,302,132 11/1981 Ogawa et al. ..... 405/269

FOREIGN PATENT DOCUMENTS 55-116918 9/1980 Japan ..... 405/269
55-161111 12/1980 Japan ..... 405/269
56-9517 1/1981 Japan ..... 405/269

*Primary Examiner*—Dennis L. Taylor
*Attorney, Agent, or Firm*—Flynn, Thiel, Boutell & Tanis

[57] ABSTRACT

A grout injection method and apparatus, characterized in that a grout comprised of two liquids and curable when the two liquids are combined are supplied, in a grout injection operation, to an injection pump, introduced through separate passages formed concentrically in the pipe, respectively, into an annular chamber formed within the pipe, and uniformly combined, contacted and mixed with each other in the annular mixing chamber before injection into the soil. The passages of the liquids communicating with the annular mixing chamber are blocked when the grout injection is not carried out.

15 Claims, 14 Drawing Figures

GROUT INJECTION METHOD AND APPARATUS

BACKGROUND OF THE INVENTION

This invention relates to a grout injection method and apparatus for injecting a grout into the ambient earth.

In general, a grout injection method has been widely employed for the stabilization of a poor subsoil and after many changes have been developed. Among these changes, the view point about the penetration of a grout has also been changed. First, it was considered that the penetration of the grout into the soil should be effected slowly to provide effective stabilization of the ground, and a grout having a gellation time of at least 60 seconds, usually, as long as several minutes to several tens of minutes was employed. In fact, this method is very effective for the stabilization of a homogeneous sandy soil. However, such a slow-curable grout having a long gellation time does not work effectively in a heterogeneous poor subsoil such as a diluvium deposit or an alluvium deposit, a sandy soil abundantly containing ground water, or a complicated ground condition with cohesive soil mingled. Especially, the slow-curable grout may often be diluted by ground water contained in the soil, during the grout injection operation, to such an extent that the desired compression strength of the stabilized mass cannot be developed, or it may escape with the ground water from the area to be treated, or flowed out the surface through a gap between an injection pipe and a wall of a bored hole. Furthermore, the slow-curable grout requires a long hardening time and accordingly requires a long standby time. For these reasons, the slow-curable grout is not always effective and not economical.

To solve these problems involved in the slow-curable grout, a novel method was developed by the inventors of the present invention around 1975. According to this method, a grout having an extremely short gellation time, i.e., gellation time of several seconds (hereinafter referred to as "instantaneously-curable grout" or "flash-curable grout") is employed, and the grout is injected into the soil, using an injection apparatus having a dual-pipe structure. This novel method has been employed since then, prevailing over the conventional method as described above. As disclosed in Japanese Patent Publication No. 38448/1980, this method uses an injection apparatus provided with a spool valve which is fitted in an inner pipe member of the double-pipe boring and injecting pipe. The spool valve is normally in an unoperated position, so as to jet a boring water pumped into a first flow passage formed in an outer pipe member, through a nozzle provided at a tip end of the boring and injecting pipe. During the injection operation, a grout comprised of two liquids which are hardened when combined (hereinafter referred to as "two-liquid type grout") is fed through the first passage and a second passage, respectively, so that the spool valve is pressed down by the liquid fed through the second passage to feed the liquid into a mixing space. The liquid fed through the first passage, is prevented from flowing to the nozzle but is allowed to flow, from the first passage, into the mixing chamber. Thus, in this mixing space, the two liquids are combined, contacted and mixed with each other.

The inventors of the present invention have confirmed, through results of various workings, that this method can provide effective stabilization of heterogeneous ground in a limited area around an injection orifice of the injection pipe. On the other hand, R. H. Karol reported on the phenomena of penetration of a flash-curable grout in Journal of the Soil Mechanics and Foundations Division of ASCE, April 1961 and January 1968. The results of the workings by the inventors are in accordance with the conclusion derived from the study on the penetration phenomena by R. H. Karol et al.

However, the method developed by the inventors of the present invention and disclosed in Japanese Patent Publication No. 38448/1980 still has some disadvantages to be improved. First, the mixing chamber should be provided within the injection pipe so as to allow the liquids to be combined, contacted and mixed in the mixing chamber before injection of the grout. Second, the liquids cannot always be mixed sufficiently because the mixing space of the conventional injection pipe is a narrow, restricted space and is located on one side of the injection pipe and, in addition, the liquids are discharged in linear forms to be combined with each other. Third, the injection pipe should be rotated around its axis, during the injection operation, for providing uniform solidification around the injection pipe, because only one injection orifice is provided in the injection pipe. Fourth, the spool valve does not always operate smoothly, because the liquid in the first passage is forced to flow around or through the spool valve.

The inventors have made intensive and extensive study with a view to solving the problems as described above and found that (1) the structure can be simplified and the operation of the spool valve can be more smooth by an arrangement in which the liquid in the first passage communicates directly with the mixing chamber instead of introducing the liquid into the mixing chamber from a by-pass formed between the outer and inner pipe members, traversing the spool valve, and (2) a plurality of injection orifices can be provided by providing an annular mixing chamber, to enable uniform injection in the limited area around the injection pipe, without rotating the injection pipe around its axis. On the basis of these findings, the inventors have made the present invention.

SUMMARY OF THE INVENTION

In accordance with a first aspect of the present invention, there is provided a grout injection method for injecting a grout composed of a first liquid and a second liquid and curable when the liquids are combined, which comprises: feeding said first liquid through a peripheral portion of an injection pipe comprised of an inner pipe member and an outer pipe member having one or more injection orifices formed in the sidewall thereof, in parallel with the axis of said injection pipe, to introduce said first liquid into an annular mixing chamber; feeding said second liquid to said inner pipe member to depress, by a pressure of the liquid, a spool valve fitted in said inner pipe member, so as to introduce said second liquid into said annular mixing chamber, combining, contacting and mixing the liquids in said annular mixing chamber; and injecting the mixture of the liquids into the ambient soil through said one or more injection orifices.

In accordance with a second aspect of the present invention, there is provided a grout injection apparatus comprising an injection pipe which comprises: an inner pipe member; an outer pipe member having one or more injection orifices formed in the sidewall thereof; a first passage formed at a peripheral portion of said injection pipe in parallel with an axis of the pipe; a second passage formed in said inner pipe member; a spool valve fitted in said inner pipe member and biased towards the base side of said injection pipe; one or more exit ports which are formed in a sidewall of said inner pipe member and adapted to be closed normally and communicate with said second passage when said spool valve is displaced towards the tip side of said injection pipe, against a biasing force thereof, upon application of a fluid pressure upon said second passage; and an annular mixing chamber formed between said inner and outer pipe members so as to communicate with said one or more injection orifices and said one or more exit ports.

In accordance with a third aspect of the present invention, there is provided a grout injection apparatus comprising an injection pipe which comprises: an inner pipe member; an outer pipe member having one or more injection orifices formed in a sidewall thereof; a first passage formed at a peripheral portion of said injection pipe in parallel with an axis of said pipe; a second passage formed in said inner pipe member; a spool valve inserted in said inner pipe member at a lower portion thereof and biased towards the base end of said injection pipe; said spool valve normally closing an exit port formed at a lower end of said inner pipe member and disengaging from said lower end of said inner pipe member to open said exit port when displaced towards the tip end of said injection pipe upon application of a fluid pressure onto said second passage; and an annular mixing chamber formed between said outer pipe member and said inner pipe member to communicate with said one or more injection orifices and said exit port.

BRIEF DESCRIPTION OF THE DRAWINGS

The invention will be better understood from the description taken in connection with the accompanying drawings in which.

DESCRIPTION OF THE PREFERRED EMBODIMENTS

Figure 1:
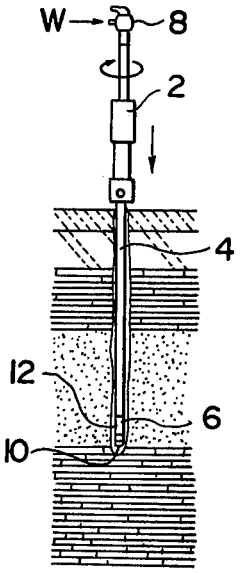
FIGS. 1 to 4 are sectional views showing the sequence of the working steps of the present invention.

Referring now to the drawings, there are illustrated preferred embodiments of the present invention. FIGS. 1 to 4 are schematic views showing the outline of the grout injection method according to the present invention. A grout injection pipe 4 is held by a chuck 2 and a tip arrangement 6 as will be described in detail referring to FIGS. 5 to 13 is connected to a tip end of the injection pipe 4.

In this arrangement, boring water is first supplied by a grout injecting pump (not shown) to the swivel 8 through a hose to jet the boring water W from a nozzle 10 as illustrated in FIG. 1. At the same time, the injection pipe 4 and the tip arrangement 6 are driven downwardly while being rotated around the axis as shown by an arrow in FIG. 1. As the boring proceeds, pipe sections are connected to the injection pipe 4 one after another.

Figure 4:
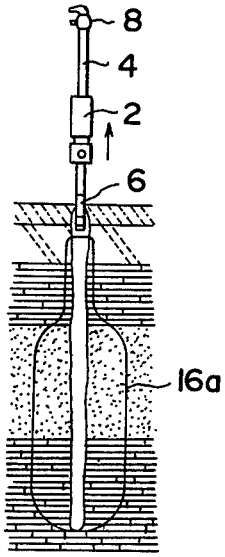

When the injection pipe 4 reaches a predetermined depth, a two-liquids type grout having a short gellation time, preferably, 30 seconds or less is supplied. More specifically, a first liquid $G_1$ and a second liquid $G_2$ are supplied through a first passage $P_1$ and a second passage $P_2$ which are formed in the injection pipe 4, respectively. The liquids are combined, contacted and mixed in a mixing chamber and injected from one or more injection orifices 12 into an ambient area to form a columnar sealing mass 14 of the grout which functions as a packer. Then, the injecting pipe is raised, as a whole, by a given distance or kept in situ without raising the pipe 4 to inject the first liquid $G_1$ and a second liquid $G_2$ into the ambient soil while mixing the liquids. The gellation time of the grout is preferably 30 seconds or less. The liquids injected from the injection orifice or orifices 12 break out the sealing mass 14 and begin to be hardened there. When the liquids are further injected, they, in turn, break out the partially hardened liquids. Thus, a stabilized mass 16 is finally formed around the injection pipe 4. Thereafter, as illustrated in FIG. 4, the injection pipe 4 is raised step by step to repeat the similar operations to form a stabilized mass **16*a* of a desired length. When the stabilized mass 16*a* is formed, the injection pipe 4** is removed.

Figure 5:
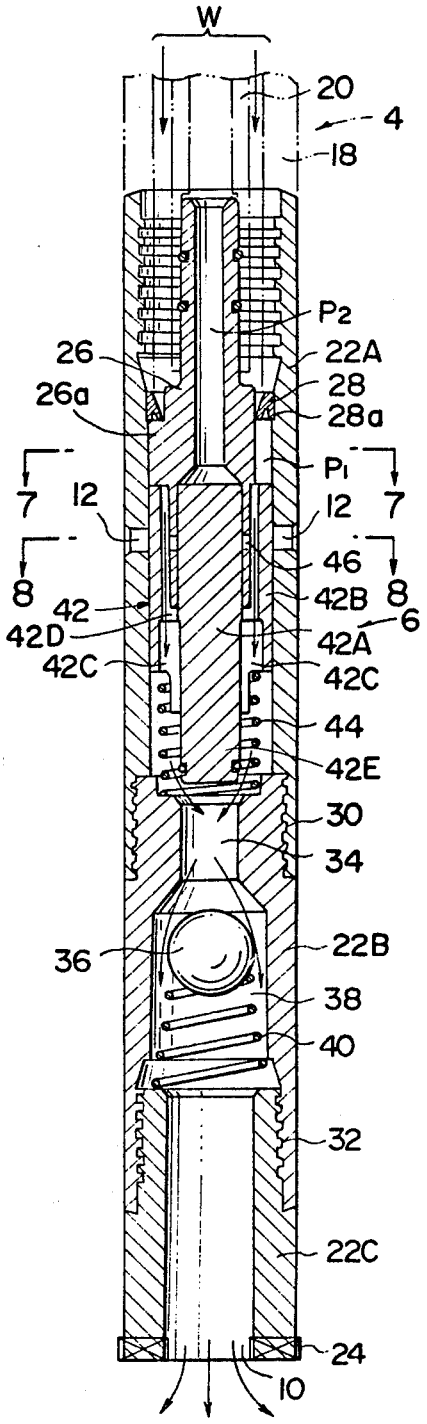
FIG. 5 is a longitudinal cross section of a tip arrangement of the grout injecting apparatus according to the present invention, shown in a position for feeding boring water.
Figure 6:
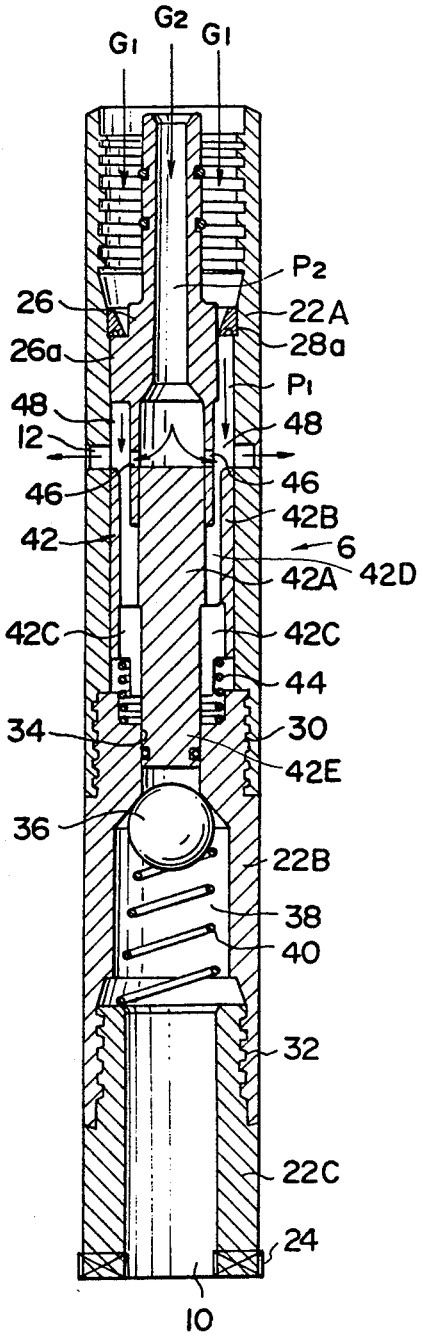
FIG. 6 is a similar longitudinal cross section of the tip arrangement, shown in a position for injecting a grout.

The detail of one form of the tip arrangement 6 is illustrated in FIGS. 5 and 6. FIG. 5 shows an operation for feeding boring water and FIG. 6 shows an operation for feeding the grout, i.e., the first and second liquids $G_1$ and $G_2$.

Figure 7:
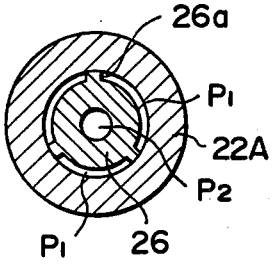
FIG. 7 is a transverse cross section taken along a line 7—7 of FIG. 5.

The tip arrangement 6 is connected to the injection pipe 4 comprised of an outer pipe member 18 and an inner pipe member 20. Numerals 22A to 22C each designates a section of an outer pipe member of the tip arrangement 6. The lowermost pipe section 22C is provided with a boring bit 24 which functions as a digging edge in the boring operation as shown in FIG. 1. Numeral 26 designates an inner pipe member of the tip arrangement having a second passage formed therein which communicates with a passage in the inner pipe member 20 of the injection pipe 4. The inner pipe member 26 is disposed in the pipe section 22A concentrically therewith, the gap defined between the pipe member 26 and the pipe section 22A forms the first passage $P_1$. The inner pipe 26 has, at an intermediate portion, three holding shoulders **26*a* projected radially and abuttable against the inner wall of the outer pipe member 22A as illustrated in FIG. 7. An annular check valve 28 is disposed at a gap between the upper faces of the shoulders 26*a* and the lower face of the outer pipe member 18 of the injection pipe 4. The check valve 28 has a lug 28*a* made of a flexible material such as a rubber etc. and in abutment against the outer periphery of the inner pipe 26 so as to partition the first passage $P_1$. Therefore, when a fluid is supplied from the above, the lug 28*a* is bent to disengage from the outer peripheral face of the inner pipe 26, allowing the flow of the fluid. On the other hand, when a fluid pressure acts from the lower side, the lug 28***a* is pressed hard against the outer periphery of the inner pipe 26 to block the flow of the fluid in the upward direction.

The sidewall of the pipe section 22A is formed with, for example, 2 to 8 injecting openings 12 which are arranged circumferentially at equal angular spaces. The pipe section 22A is screw threadedly engaged with the pipe section 22B through a threaded portion 30. Similarly, the pipe section 22B is, in turn, threadedly coupled to the pipe section 22C through a threaded portion 32. The pipe section 22B has, at the upper portion thereof, a guide path or passageway 34 which communicates, at a lower portion thereof, with a check valve encasing chamber 38 encasing a ball type check valve 36. The check valve 36 is biased towards the base end of the tip arrangement (upwardly as viewed in FIG. 5) by a compression spring 40 resting on the upper face of the pipe section 22C and blocks the guide path 34 when no fluid is applied.

Numeral 42 is a spool valve which is comprised of a spool portion 42A fitted in a lower portion of the inner pipe 26 and a shutter portion 42B formed integrally with the spool portion 42A and formed as a thin annular member which is fitted in the pipe section 22A and adapted to close the injection orifices 12. The spool valve 42 has a plurality of through holes 42C formed in parallel with the axis of the tip arrangement 6. This spool valve 42 is urged towards the base side by a spring 44 resting against a recess formed on the upper face of the pipe section 22B. Numeral 46 designates one or more exit ports which are formed in the sidewall of the inner pipe 26 at a position, in the longitudinal direction, corresponding to the injection orifices 12.

In the so formed tip arrangement 6, when boring water W is fed into the gap between the outer pipe 18 and the inner pipe 20 as illustrated in FIG. 5, the boring water W flows into the first passage $P_1$ while bending the lug 28*a*, then further flows to the guide path 34 through the annular gap 42D between the spool portion 42A and shutter portion 42B of the spool valve 42 and through the through holes 42C, to depress the check valve 36 against the action of the spring 40. The boring water W is, then, jetted from the nozzle 10 through the pipe section 22C. Thus, boring can be effected as described above referring to FIG. 1.

Figure 2:
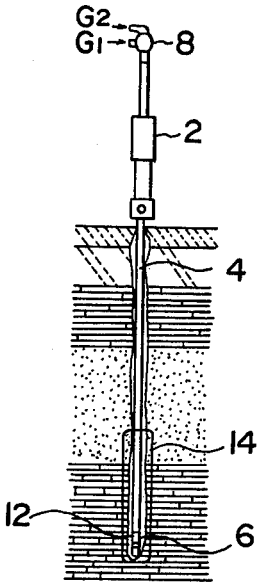
Figure 3:
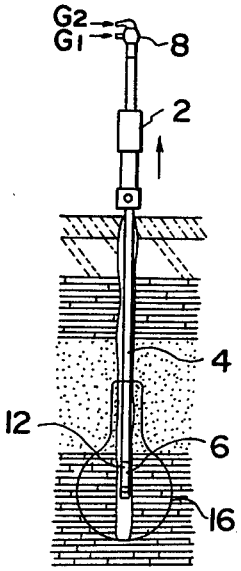

On the other hand, to form the sealing mass 14 or the stabilized mass 16 as illustrated in FIG. 2 or in FIG. 3, a first liquid $G_1$ is pumped into the first passage $P_1$ and a second liquid $G_2$ is pumped into the second passage $P_2$ as illustrated in FIG. 6. As the second liquid $G_2$ is being pumped, a pressure acts on the upper face of the spool portion 42A. When the pressure prevails over the urging force of the spring 44, the spool valve 42 is depressed. As a result, the second liquid $G_2$ is discharged from the exit port or ports 46 in the horizontal direction. In accordance with the depression of the spool valve 42, the shutter portion 42B is lowered from the injection orifices 12, so that an annular mixing chamber 48 is formed between the pipe section 22A and the inner pipe 26. The second liquid $G_2$ discharged from the exit port or ports 46 enters the mixing chamber 48. On the other hand, as a result of the depression of the spool valve 42, a lower portion 42E of the spool portion 42A of the spool valve 42 is inserted into the guide path 34 to block the guide path 34. While the second liquid $G_2$ is flowing into the annular mixing chamber 48, the first liquid $G_1$ also enters the mixing chamber 48 from the first passage $P_1$. At this time, since the guide path 34 has already been closed by the spool portion 42A, the first liquid $G_1$ is combined, contacted and mixed with the second liquid $G_2$ substantially at right angles with each other in the annular mixing chamber 48. The mixture is then injected through the injection orifices 12 into the ambient soil uniformly in the radial direction.

When the liquid supply to the first passage $P_1$ and the second passage $P_2$ is stopped to release the pressure against the spool valve 42, the spool valve 42 is moved upwardly and the outer peripheral wall of the spool portion 42A closes the exit port or ports 46 and simultaneously opens the guide path 34. The outer peripheral wall of the shutter portion 42B closes the injection orifices 12 and the check valve 36 closes the guide path 34 which has been opened upon the rising of the spool valve 42.

Since a plurality of injection ports 12 are formed on the pipe section 22A, it is not necessary to rotate the injection pipe around its axis. Uniform grout injection can be effected around the injection pipe without rotating the injection pipe around its axis as required in the conventional technique which the inventors developed before. Of course, the injection pipe may be rotated in the present invention, too, to obtain a desired effect. Furthermore, since the mixing chamber 48 is annular, the first liquid $G_1$ and the second liquid $G_2$ are injected from the injection ports 12, 12 . . . while being mixed with each other in the chamber uniformly in the circumferential direction. Thus, the combination of the plural formation of the injection orifices on the injection pipe and the annualar formation of the mixing chamber 48 enables improved grout injection. In this connection, if the number of the discharge ports 46 is plural, easiness of the mingling and degree of the mixing can be further enhanced.

The first passage $P_1$ always communicates with the annular mixing chamber 48, irrespective of the position of the spool valve 42. By contrast, in the conventional grout apparatus as described in the aforesaid Japanese Patent Publication 38448/1980, the first liquid is allowed to pass through the wall surrounding the spool valve, pass through the spool valve and flow out through an exit port formed on another side of the wall only when the second liquid is supplied to the second passage. Therefore, if the first liquid is solidified between the spool valve and the surrounding wall, smooth movement of the spool valve will be prevented. In the embodiment of the present invention as described above, however, the first liquid $G_1$ is fed directly to the annular mixing chamber 48 without traversing the inner pipe 26 and running around the spool valve 42. With this arrangement, smooth operation of the spool valve 42 is assured even after a long use of the apparatus. The first liquid $G_1$ and the second liquid $G_2$ are water glass and a hardener, respectively, but may be vice versa. For a water-glass based grout, many types of hardener may be used. As the hardener employable in the present invention, there can be mentioned inorganic hardeners such as phosphates, bicarbonates and bisulfates, an organic hardener such as glyoxal and ethylene carbonate and a combination thereof.

Upon completion of the injection operation, the spool valve 42 is raised immediately, so that the injection orifices 12 are closed by the shutter portion 42A and the guide path 34 is blocked by the check valve 36. Thus, it can surely be prevented that slime from the ambient ground enters the injection pipe which will cause various troubles. Simultaneously, the exit port or ports 46 is closed by the spool portion 42A, so that the mixture of the liquids remaining in the annular mixing chamber 48 is prevented from entering the second passage $P_2$ through the exit port or ports 46. This arrangement further assures smooth operation of the spool valve 42. The mixture remaining in the mixing chamber 48 is prevented from returning back to the base portion of the grout pipe by the check valve 28. The mixture may be partially solidified in the chamber. However, it has been confirmed by the experiments conducted by the inventors that if such solidification occurs, the formed mass can easily be discharged through the injection orifices 12 when the injection operation starts again.

In general, it is considered that when the mixture of the first liquid $G_1$ and the second liquid $G_2$ having a short gellation time is left in the annular mixing chamber 48 after the supply of the liquids $G_1$, $G_2$ has been stopped due to completion or interruption of the injection operation, the mixture is solidified there, blocking the rising of the shutter portion 42B of the spool valve 42. However, since there is a time lag between the times the first and the second liquid $G_1$ and $G_2$ are actually stopped, the ratio of the first liquid $G_1$ to the second liquid $G_2$ which are contained in the mixture remaining in the mixing chamber 48 gets out of the range suitable for solidification, and the mixture can not completely be solidified. Therefore, the spool valve 42 can smoothly be restored to its original position, overcoming the solidifying force of the mixture, with the aid of the spring 44.

In this connection, it is to be noted that after the step of FIG. 2, a grout having a gellation time of more than 60 seconds, usually, several minutes to several tens of minutes may be supplied only to the first passage $P_1$ and injected through the nozzle 10, to form a stabilized mass of a slow-curable grout in a sandy subsoil under the sealing mass 14. In this case, the slow-curable grout forced out of the nozzle 10 is blocked by the previously formed sealing mass 14 and only allowed to spread downwardly or horizontally. Alternatively, after the injection of the flash-curable grout, a slow-curable grout may be injected through the injection orifices 12. Although FIGS. 1 to 4 illustrate the injection method in which the injection is carried out by pulling up the grout pipe step by step from its lowermost position, the injection of the present invention can also be effected by lowering the grout pipe from an initial upper position.

Figure 9:
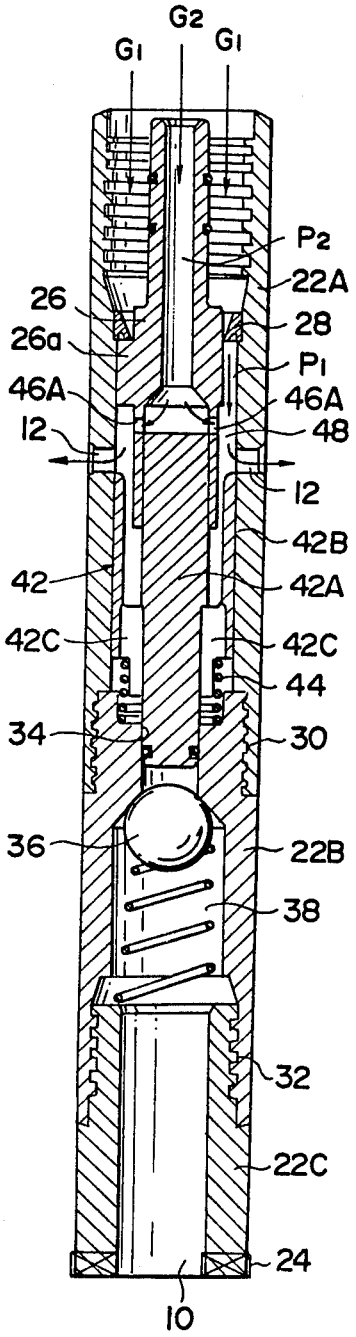
FIGS. 9 and 10 are longitudinal cross sections of modifications of the tip arrangement shown in FIG. 5, respectively.
Figure 10:
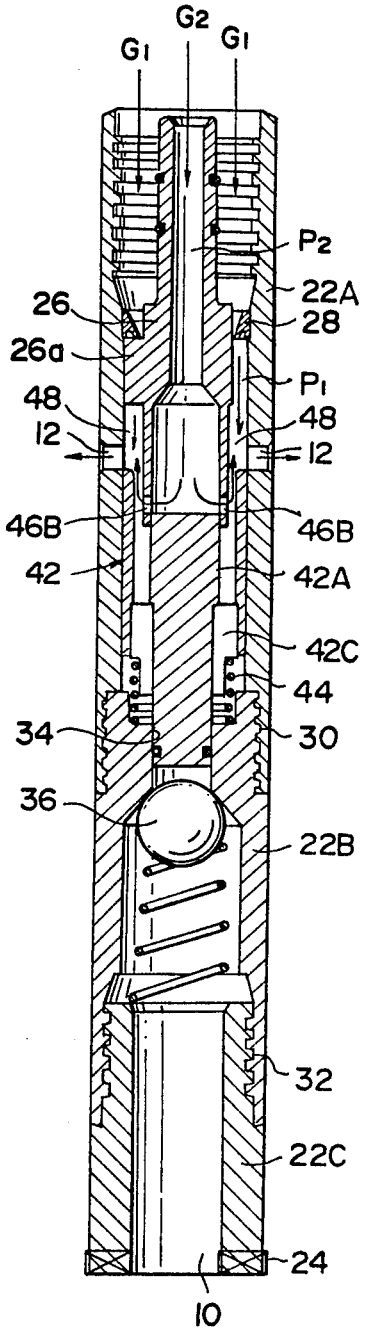

Although the positions of the injection orifices 12 in the longitudinal direction of the injecting pipe are the same as those of the exit port or ports 46 in the foregoing embodiment, so as to combine the liquids $G_1$ and $G_2$ perpendicularly to each other, an exit port or ports 46A may alternatively be located higher than the positions of the injection orifices as illustrated in FIG. 9 to provide perpendicular combining of the liquids. In the latter case, the combining of the liquids $G_1$ and $G_2$ is effected earlier than the embodiment illustrated in FIGS. 5 and 6. Alternatively, an exit port or ports 46B may be lower than the injection orifices 12, as illustrated in FIG. 10. In this case, the second liquid $G_2$ rises in a gap between the spool portion 42A and the shutter portion 42B and is combined and mixed, in counterflow contact, with the first liquid $G_1$ at the inside of the injection orifices 12 and injected through the injection orifices 12.

Figure 11:
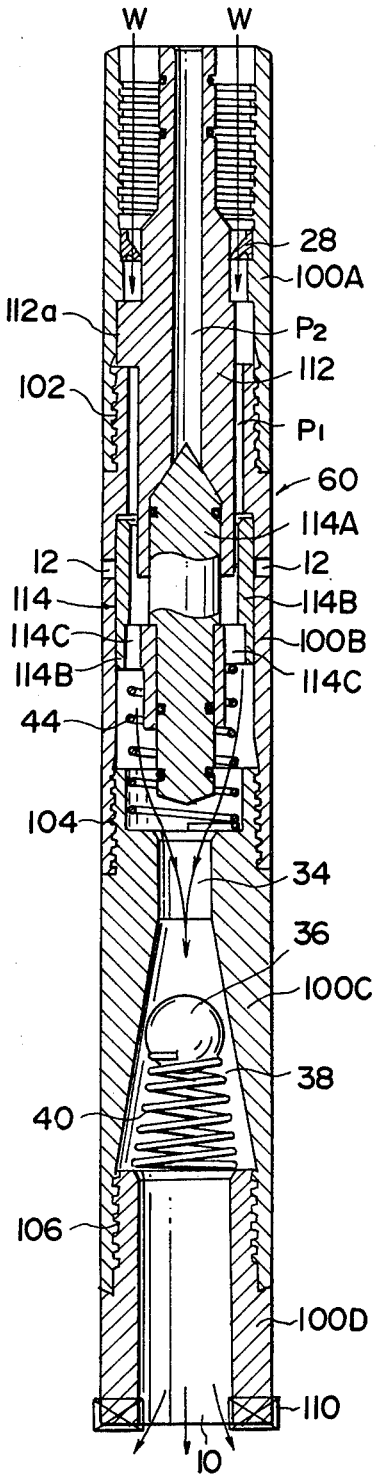
FIG. 11 is a longitudinal cross section of another form of the tip arrangement according to the present invention, shown in a position for feeding boring water.
Figure 12:
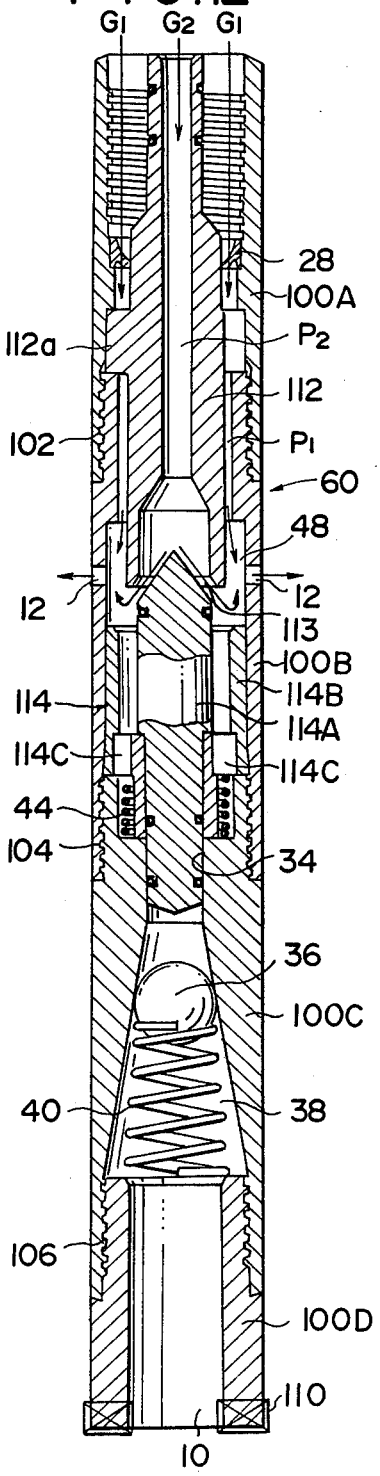
FIG. 12 is a similar longitudinal cross section of the tip arrangement, shown in a position for injecting a grout.

Another form of tip arrangement 60 employable in the present invention is illustrated in FIGS. 11 and 12. An outer pipe member is comprised of pipe sections 100A to 100D which are connected to each other by threaded portions 102, 104 and 106, and a boring bit is provided at a tip end of the outer pipe member. Numeral 112 designates an inner pipe member which differs from the inner pipe member of the tip arrangement illustrated in FIGS. 5 and 6, in that the exit port or ports 46, 46A or 46B formed in the sidewall of the inner pipe member 112 are replaced by an exit port 113 which opens at the lower end of the inner pipe member 112 located a bit lower than the injection orifices 12. The inner pipe member 112 has a holding shoulder **112*a* which is held and fixed between a stepped portion formed at a lower end of the pipe section 100A and a stepped portion formed at an upper portion of the pipe section 100B. Numeral 114 designates a spool valve with a conical head portion which has a spool portion 114A, a shutter portion 114B radially spaced from the spool portion 114A and through-holes 114C. In the embodiment as illustrated, the spool portion 114A and the shutter portion 114B are separate parts and assembled into an integral body by pins etc. Other parts or portions are substantially identical with the corresponding parts or portions of the tip arrangement of FIGS. 5 and 6** and denoted by the same numerals.

In operation, when the boring water W is supplied as illustrated in FIG. 11, the boring water W is jetted from the nozzle 10 as indicated by arrows. When the first liquid $G_1$ and the second liquid $G_2$ are supplied to the first passage $P_1$ and the second passage $P_2$, respectively, as illustrated in FIG. 12, the first liquid $G_1$ flows down into the annular mixing chamber 48 through the first passage $P_1$. The second liquid $G_2$ depresses the spool valve 114 against the biasing force of the spring 44. As a result, the second liquid $G_2$ passes through a gap formed between the lower end periphery of the inner pipe member 112 and the conical face of the head portion of the spool portion 114A and uniformly discharged obliquely downwardly into the annular mixing chamber 48. The second liquid $G_2$, then, turns upwardly to be combined, contacted and mixed, in a counterflow manner, with the first liquid $G_1$ which flows downwardly, and the mixture is injected through the injection orifices into the ambient earth.

In this embodiment, the second liquid $G_2$ uniformly enters the annular mixing chamber 48 and is uniformly combined, contacted and mixed with the first liquid $G_1$ which is also uniformly fed into the annular mixing chamber 48.

The lower end of the inner pipe member 112 of the tip arrangement 60 may be located in the base side than the position thereof as illustrated in FIGS. 11 and 12, to obtain perpendicular or oblique combination, contact and mixing of the liquids.

Figure 13:
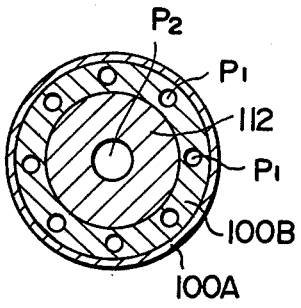
FIGS. 13 and 14 are transverse cross sections each showing a modified formation of a first passage.
Figure 8:
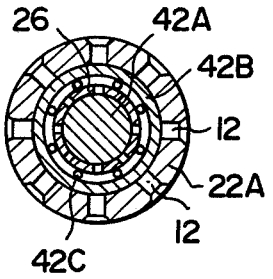
FIG. 8 is a transverse cross section taken along a line 8—8 of FIG. 5.
Figure 14:
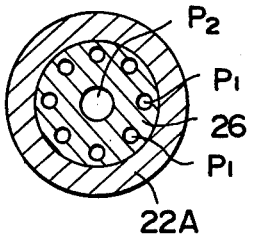

Although the first passage $P_1$ is provided in a space defined by the outer and inner pipe members in the embodiments as described above, a plurality of first passages $P_1$, $P_1$ . . . may alternatively be formed in the pipe section 100B in parallel with the axis of the pipe as illustrated in FIG. 13, or a plurality of first passages $P_1$, $P_1$ . . . may be formed in the inner pipe 26 as illustrated in FIG. 14.

The grout injection apparatus as described above are suitable especially for the injection of a flash-curable grout having a gellation time of 30 seconds or less, but they may be applied to the injection of a slow-curable grout, too.

As describved above, according to the first embodiment of the present invention, the mixing chamber is shaped in an annular form, so that uniform combining, contact and mixing of the liquids can be effected. And, a plurality of injection orifices are provided so that uniform injection is effected without rotating the injection pipe.

According to the second embodiment, the position of the exit ports may be selected to provide various combining manners according to necessity.

According to the third embodiment, since the exit port is formed at the lower end of the inner pipe member, uniform combining, contact and mixing of the liquids can be obtained in cooperation with the function of the annular mixing chamber.

We claim:

1. A method of injecting grout into soil, the grout being prepared by mixing a first liquid and a second liquid to form a grout, the method being performed by using an injection pipe comprising an outer pipe member and an inner pipe member coaxially disposed in said outer pipe member, said outer pipe member having a nozzle at the tip end thereof for jetting a boring fluid therefrom, an axially extending guide passageway in said outer pipe member spaced upwardly from said tip end thereof, injection orifice means in the peripheral wall of said outer pipe member spaced upwardly from said guide passageway, said inner pipe member extending from the upper end of said injection pipe partway along the length thereof to a location close to said injection orifice means, said inner pipe member having exit port means at or close to the lower end thereof, an axially slidable spool valve fitted in said outer pipe member between the lower end of said inner pipe member and said guide passageway, resilient means continuously urging said spool valve upwardly in a direction away from the tip end of said outer pipe member to a first upper position, said spool valve being movable toward said tip end to a second lower position in which said spool valve closes said guide passageway, said spool valve having an upright central spool portion axially slidably receivable in said inner pipe member to close said exit port means when said spool valve is in said first position and to open said exit port means when said spool valve is in said second position, said central spool valve portion having an upper surface adapted to be acted on by the pressure of the liquid fed into said inner pipe member so that said spool valve can be moved from said first position to said second position against the urging of said resilient means when pressurized liquid is fed into said inner pipe member, said spool valve having a peripheral shutter portion integral with said spool portion and axially slidably disposed in the space between said inner and outer pipe members for closing said injection orifice means when said spool valve is in said first position and for opening said injection orifice means when said spool valve is in said second position, said inner and outer pipe members defining a first passage therebetween, said inner pipe member defining a second passage therewithin, said inner and outer pipe members and said spool valve defining a mixing chamber in said first passage when said spool valve is in said second position, said mixing chamber being located between and communicating with said exit port means and said injection orifice means, said spool valve having axially extending through holes located between said spool portion and said shutter portion and providing communication between said first passage and said guide passageway, said method comprising the steps of feeding only a boring fluid into said first passage while said spool valve is maintained in said first position so that the boring fluid flows through said first passage, said through holes, said guide passageway and thence out the top of said injection pipe whereby to bore a hole in the ground; then feeding said first and second liquids through said first and second passages, respectively, the pressure of said second liquid being effective to shift said spool valve to said second position whereby to block said guide passageway, open said exit port means and said injection orifice means and form said mixing chamber so that the first and second liquids meet, contact and mix with each other in the mixing chamber and the mixture thereof is injected through the injection orifice means into the ground.

2. A grout injection method as claimed in claim 1, wherein said grout has a gellation time of 30 seconds or less.

3. A grout injection method as claimed in claim 1, wherein a plurality of circumferentially spaced-apart injection orifices are disposed in the sidewall of the outer pipe member and said grout is injected uniformly through the respective injection orifices.

4. A grout injection method as claimed in claim 3, wherein the injection is carried out, while keeping said injection pipe fixed in situ without rotating the pipe.

5. A grout injection method as claimed in claim 1, wherein said first and second liquids are combined and contacted with each other by directing them substantially at right angles with each other into said mixing chamber.

6. A grout injection method as claimed in claim 1, wherein said first and second liquids are combined with each other so as to allow counterflow contact therebetween.

7. A grout injection apparatus for injecting grout into soil, the grout being prepared by mixing a first liquid and a second liquid to form a grout, comprising: an injection pipe comprised of an outer pipe member and an inner pipe member coaxially disposed in said outer pipe member, said outer pipe member having a nozzle at the tip end thereof for jetting a boring fluid therefrom, an axially extending guide passageway in said outer pipe member spaced upwardly from said tip end thereof, injection orifice means in the peripheral wall of said outer pipe member spaced upwardly from said guide passageway, said inner pipe member extending from the upper end of said injection pipe partway along the length thereof to a location close to said injection orifice means, said inner pipe member having exit port means at or close to the lower end thereof, an axially slidable spool valve fitted in said outer pipe member between the lower end of said inner pipe member and said guide passageway, resilient means continuously urging said spool valve upwardly in a direction away from the tip end of said outer pipe member to a first upper position, said spool valve being movable toward said tip end to a second lower position in which said spool valve closes said guide passageway, said spool valve having an upright central spool portion axially slidably receivable in said inner pipe member to close said exit port means when said spool valve is in said first position and to open said exit port means when said spool valve is in said second position, said central spool portion having an upper surface adapted to be acted on by the pressure of the liquid fed into said inner pipe member so that said spool valve can be moved from said first position to said second position against the urging of said resilient means when pressurized liquid is fed into said inner pipe member, said spool valve having a peripheral shutter portion integral with said spool portion and axially slidably disposed in the space between said inner and outer pipe members for closing said injection orifice means when said spool valve is in said first position and for opening said injection orifice means when said spool valve is in said second position, said inner and outer pipe members defining a first passage therebetween, said inner pipe member defining a second passage therewithin, said inner and outer pipe members and said spool valve defining a mixing chamber in said first passage when said spool valve is in said second position, said mixing chamber being located between and communicating with said exit port means and said injection orifice means, said spool valve having axially extending through holes located between said spool portion and said shutter portion and providing communication between said first passage and said guide passageway whereby a boring fluid can be flowed into said first passage while said spool valve is maintained in said first position so that the boring fluid will flow through said first passage, said through holes, said guide passageway and thence out the tip of said injection pipe whereby to bore a hole in the ground, and then the first and second liquids can be fed through said first and second passages, respectively, the pressure of said second liquid being effective to shift said spool valve to said second position whereby to block said guide passageway, open said exit port means and said injection orifice means and form said mixing chamber so that the first and second liquids meet, contact and mix with each other in the mixing chamber and the mixture thereof is injected through the injection orifice means into the ground.

8. A grout injection apparatus as claimed in claim 7, wherein said exit port means are located upwardly from said injection orifice means.

9. A grout injection apparatus as claimed in claim 7, wherein said exit port means are located at a position or positions corresponding, both circumferentially and longitudinally, to those of said injection orifice means.

10. A grout injection apparatus as claimed in claim 7, 8 or 9, wherein a plurality of circumferentially spaced-apart injection orifices are formed in the sidewall of said outer pipe member.

11. A grout injection apparatus as claimed in claim 7, wherein a plurality of circumferentially spaced-apart injection orifices are formed in the sidewall of the outer pipe member.

12. A grout injection apparatus as claimed in claim 7, wherein said exit port is located below said injection orifice means.

13. A grout injection apparatus as claimed in claim 7, wherein said exit port means are formed in the sidewall of said inner pipe member and are spaced upwardly from the lower end of said inner pipe member, said spool portion of said spool valve being continuously received in said inner pipe member in said first and second positions of said spool valve.

14. A grout injection apparatus as claimed in claim 7, wherein said exit port means is defined by the lower end of said inner pipe member and wherein the upper surface of said spool portion of said spool valve is spaced downwardly from said lower end of said pipe member when said spool valve is in said second position.

15. A grout injection apparatus as claimed in claim 7, including a check valve in said first passageway above said injection orifice means for permitting flow of liquid downwardly in said first passageway and preventing flow of liquid upwardly in said first passageway.

* * * * *